United States Patent [19]

Lewis et al.

[11] Patent Number: 4,623,235

[45] Date of Patent: Nov. 18, 1986

[54] SINGLE USE FILM DEVELOPING ASSEMBLY

[75] Inventors: Jean D. Lewis, Westport; Willfred Goldschmidt, Weston; Donald Coiro, Huntington, all of Conn.; Phillip V. Engler, Tarrytown, N.Y.

[73] Assignee: Scop-X Research and Development Limited Partnership, New York, N.Y.

[21] Appl. No.: 631,890

[22] Filed: Jul. 18, 1984

[51] Int. Cl.[4] ..... G03D 3/00

[52] U.S. Cl. ..... 354/312; 354/331

[58] Field of Search ..... 354/304, 307, 312, 315, 354/331, 337

[56] References Cited

U.S. PATENT DOCUMENTS

| | | | |
|---|---|---|---|
| 3,280,718 | 10/1966 | Decrop | 354/312 |
| 3,646,872 | 3/1972 | Bowlby | 354/312 |
| 3,646,873 | 3/1972 | Bowlby | 354/331 |
| 3,680,464 | 8/1972 | Bowlby | 354/331 |
| 3,680,465 | 8/1972 | Bowlby | 354/331 |
| 3,680,466 | 8/1972 | Bowlby | 354/331 |
| 3,714,881 | 2/1973 | Bowlby | 354/307 |

*Primary Examiner*—A. A. Mathews

*Attorney, Agent, or Firm*—Kenyon & Kenyon

[57] ABSTRACT

A disposable film developing assembly comprises a container having a developing chamber and an additional chamber upstream thereof for receiving a film wrap. A developer envelope containing film treating fluid is disposed inside the container, tabs on the envelope being connected to the container for tearing open the envelope and permitting the release of fluid therefrom upon a withdrawal of the envelope from the container. Linking elements for coupling a film to the envelope are provided, whereby the film is drawn from the film wrap into the developing chamber during a withdrawal of the envelope from the container. The envelope has a fluid containing pocket with a pair of longitudinally staggered extensions projecting from the longitudinal edges of the envelope towards the longitudinal edges of the container. Tabs are connected to the envelope at the extensions of the envelope pocket and are folded at creases over the respective extensions. Each tab is provided with a respective cut and is torn along a line extending from the cut through the respective extension. The distances between the tab creases and the respective extensions differ, so that the pocket is torn open at the extension closer to the inlet opening of the developer container before the pocket is torn open at the other extension. The film wrap receiving chamber has longitudinally extending ribs each with a projection, whereby a pucker formed in the film wrap upon a removal of the film therefrom is preserved.

29 Claims, 20 Drawing Figures

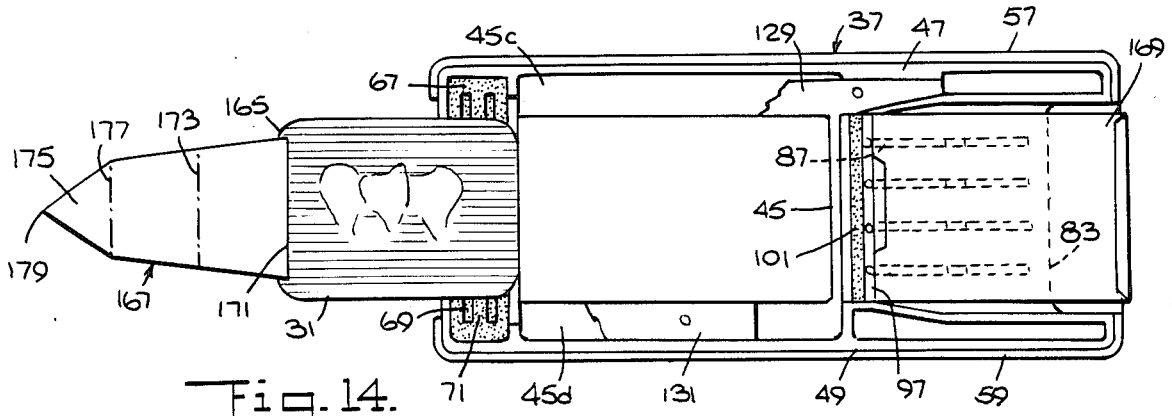
Fig. 14.
Fig. 3.
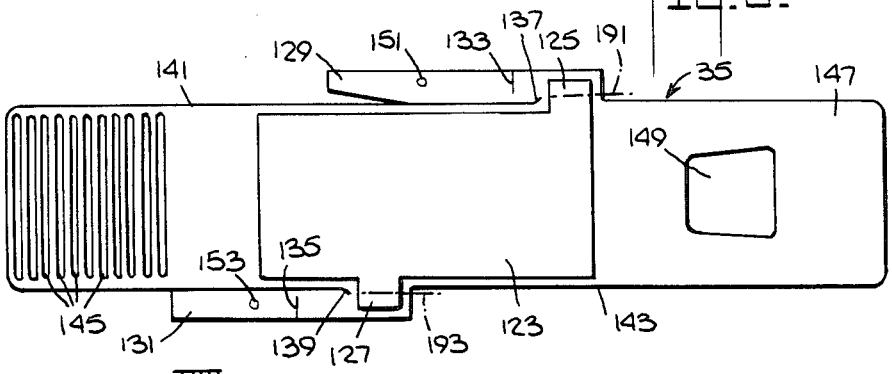
Fig. 4.
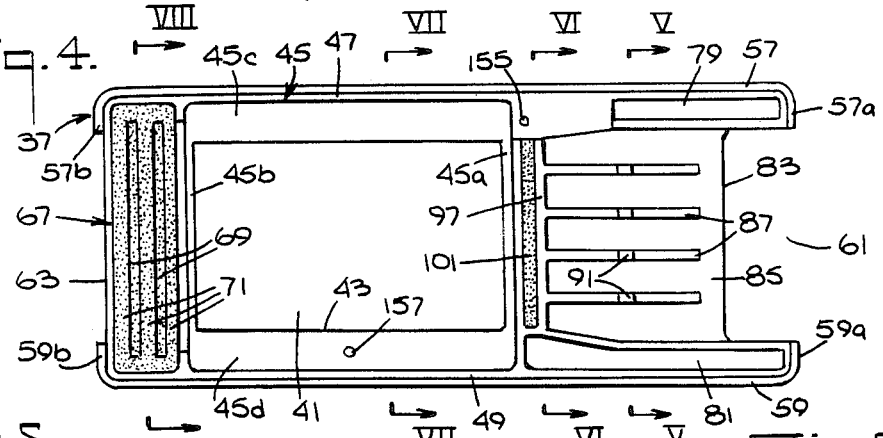
Fig. 5.
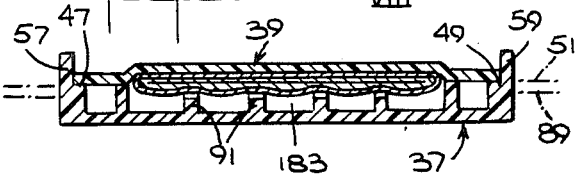
Fig. 7.
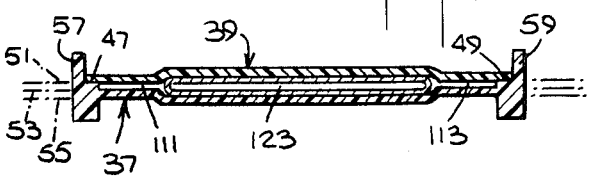
Fig. 6.
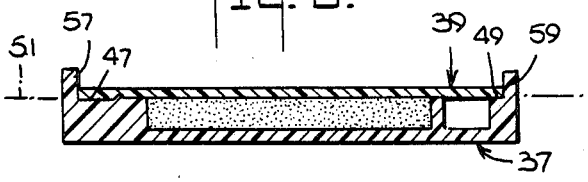
Fig. 8.
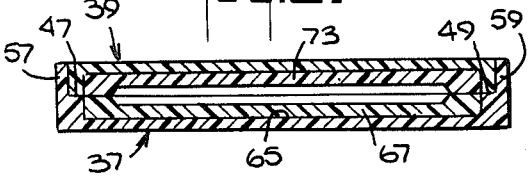

SINGLE USE FILM DEVELOPING ASSEMBLY

BACKGROUND OF THE INVENTION

This invention relates generally to photography and more particularly to a disposable or single use assembly for developing exposed radiation sensitive-film.

Disposable or single use film developers such as described in U.S. Pat. Nos. 3,680,464, 3,680,465, 3,680,466 and 3,714,881 comprise a developer pack or container having a chamber for receiving developing fluid together with an exposed light sensitive film. A package in the form of an envelope containing a film-treating solution or fluid is disposed inside the chamber and has a pair of outwardly extending tabs secured to the container. A leading end of the fluid containing envelope projects through an outlet opening in the container while a trailing end of the envelope is provided with an aperture engagable with a tooth on the film. A user inserts a film wrap containing the film into an inlet opening of the container, whereupon the tooth on the film is hooked through the aperture on the envelope. The user then grips the leading end of the envelope and pulls the envelope together with the film through the container. The withdrawal of the envelope from the developing chamber of the container causes the envelope to rupture in the regions of the tabs, whereupon the film treating fluid flows from the envelope into the developing chamber of the container. The tooth on the film is released from the trailing end of the envelope upon the passage of the trailing end through the outlet opening of the container, whereby the film is positioned in the developing chamber. Subsequently, the user withdraws the film from the chamber by griping the tooth and pulling the film through the outlet opening of the container.

U.S. Pat. Nos. 3,646,872 and 3,646,873 are also directed to disposable film developers and film envelopes.

An object of the present invention is to provide an improved film developer of the above-described type.

A more specific object of the present invention is to provide such an improved film developer in which the transmission of light energy through the inlet opening and outlet opening of the container into the developing chamber is substantially eliminated.

Another more specific object of the present invention is to provide such an improved film developer in which the release of film treating fluid from the envelope into the developing chamber is controlled, preferably in both space and time.

Yet another object of the present invention is to provide such a film developer with improved means for rupturing the film containing envelope upon the withdrawal thereof from the developing chamber.

SUMMARY OF THE INVENTION

A disposable assembly for developing exposed radiation sensitive film comprises a container, a developer package positioned in the chamber, one or more tabs integral with the package and secured to the container, and linking elements for coupling the package to the film. The container has an inlet end and an outlet end and a developing chamber disposed therebetween, while the developer package comprises a sealed rupturable envelope containing a film-treating fluid. As the envelope is withdrawn from the chamber, the tabs are torn to rupture the envelope to permit the fluid to enter the chamber. The linking elements function in part to position the film in the chamber as the ruptured envelope is withdrawn therefrom.

In accordance with the present invention the tab means includes a first tab and a second tab spaced from one another, the first tab being preferably disposed at a distance from the inlet end of the container less than the distance of the second tab from the inlet end. In addition, the disposable assembly may be provided with delay means for ensuring that the rupture of the envelope at the second tab occurs after the rupture of the envelope at the first tab.

In accordance with another feature of the present invention, the container has a first longitudinal edge and a second longitudinal edge opposed to one another and the developer envelope has at least one extension communicating with the fluid in the envelope and projecting towards one of the longitudinal edges of the container, a tab being integral with the envelope at the extension. Preferably, the envelope has a first extension projecting towards the first longitudinal edge of the container and a second extension projecting towards the second longitudinal edge. The first tab is integral with the envelope at the first extension and the second tab is integral with the envelope at the second extension, the tabs being secured to the container at the first and the second longitudinal edge, respectively, whereby as the envelope is withdrawn from the chamber the pocket is torn at the first extension and the second extension to permit fluid to enter the developing chamber.

In accordance with a more particular feature of the present invention, the first tab is folded over at a first crease to overlie the first extension, while the second tab is folded over at a second crease to overlie the second extension. The first tab has a first cut and is torn substantially along a first line from the first cut through the first extension as the envelope is withdrawn from the chamber. Similarly, the second tab has a second cut and is torn along a second line from the second cut through the second extension as the envelope is withdrawn from the developing chamber. The first crease is spaced from the first extension at a distance which is less than the distance of the second crease from the second extension, whereby the envelope begins to tear at the first extension before it begins to tear at the second extension.

The provision of laterally projecting pocket extensions and the folding of the pull tabs over the extensions ensure that sufficiently large tears are made in the envelope during withdrawal thereof from the container to enable the complete transfer of the film treating fluid from the envelope into the developing chamber of the container. The pocket extensions and the overlapping pull tabs also serve to reduce friction between the envelope and the container, thereby facilitating the withdrawal of the envelope. In addition, these features cofunction to minimize the amount of the envelope material which remains in the container upon withdrawal of the envelope. The folding over of the tabs and the connection thereof to the container ensure anchoring of the envelope remnants so that they do not float in the film treating fluid and damage the film.

Pursuant to another feature of the present invention, the first tab and the second tab are connected to the container by means of respective nipples thereon engaging the tabs.

Pursuant to yet another feature of the present invention, the container has a first side and a second side defining in part respective walls of the developing chamber. At least one side of the container is resilient, whereby the container may be squeezed to distribute the film-treating fluid throughout the developing chamber upon withdrawal of the envelope from the chamber.

Upon the pulling of the film out of the film wrap, the film wrap forms a pucker which is held in position by the transversely extending projection in the additional chamber. The pucker serves in part to form a light barrier at the entrance end of the developing chamber.

Pursuant to a further feature of the invention, the container has an entry or receiving chamber at the inlet end for receiving a film wrap containing the film. The disposable assembly further comprises blocking means integral with the container and cooperating with a film wrap for at least partially preventing the penetration of light into the developing chamber. The light blocking means advantageously includes structure in the form of gripping means for at least inhibiting the release of the pucker formed in the film wrap by forces arising during the extraction of the film from the film wrap. Preferably, the gripping means comprises a projection extending in the entry chamber from one side or wall thereof towards the other side. The projection has advantageously a ramp shape on a side facing the inlet end of the container and a step shape on a side facing the developing chamber, the ramp shape facilitating insertion of the film wrap and the step shape preventing the release of the pucker or wrinkle. Both sides of the container are preferably rigid in the region of the entry chamber.

Another advantageous feature of the present invention consists essentially of providing an elongate sponge between the entry chamber and the developing chamber for substantially preventing the passage of film-treating fluid from the developing chamber into the entry chamber. In addition, a squeegee member formed of resilient material and provided with at least one groove extending substantially perpendicularly to the longitudinal edges of the container is advantageously provided at the outlet end of the container for preventing the passage of fluid from the developing chamber through the outlet end of the container and for wiping fluid from the film as the film is withdrawn from the developing chamber. The groove acts as a wick which creates a vacuum in the developing chamber as the envelope is withdrawn therefrom, thereby preventing the formation of bubbles in the film treating fluid and facilitating the flow thereof into the spaces between the envelope and the walls of the container in the region of the developing chamber.

In a film developer according to the present invention, the film-treating fluid is released initially at an input or upstream end of the developing chamber and subsequently at a point downstream of the initial rupture point. The release of developing fluid at different places, as well as at different times, results in a more uniform distribution of the film treating fluid throughout the developing chamber. The creation of voids or air bubbles in the fluid and concomitant spots on the developed film is thereby eliminated to a great extent. The even distribution of the fluid is further ensured by squeezing the container in the region of the developing chamber.

The delay or time interval between the tearing of the envelope or pouch at one extension and the tearing at the other extension has the further advantage of reducing the force required to advance the pouch out of the container.

The flow of developing fluid from the extensions of the pocket in the fluid containing envelope is advantageously guided by relatively thin flanking portions or channels of the developing chamber in which flanking portions the extensions of the envelope pocket are disposed.

BRIEF DESCRIPTION OF THE DRAWING

FIG. 3 is a top view of the developer package of FIG. 2.

FIG. 4 is a top view of a developer container half of FIG. 2, showing the structures on an inner side thereof.

FIG. 5 is a transverse cross-sectional view taken along line V—V in FIG. 4.

FIG. 6 is a transverse cross-sectional view taken along line VI—VI in FIG. 4.

FIG. 7 is a transverse cross-sectional view taken along line VII—VII in FIG. 4.

FIG. 8 is a transverse cross-sectional view taken along line VIII—VIII in FIG. 4.

FIG. 13 is a top view similar to FIGS. 9–12, showing the disposition of the film in the developing chamber upon disengagement of the developer package from the film at the outlet opening of the developer container.

FIG. 14 is a top view similar to FIGS. 9—13, showing the film upon withdrawal thereof from the developing chamber of the container.

DETAILED DESCRIPTION

Figures 1, 2:
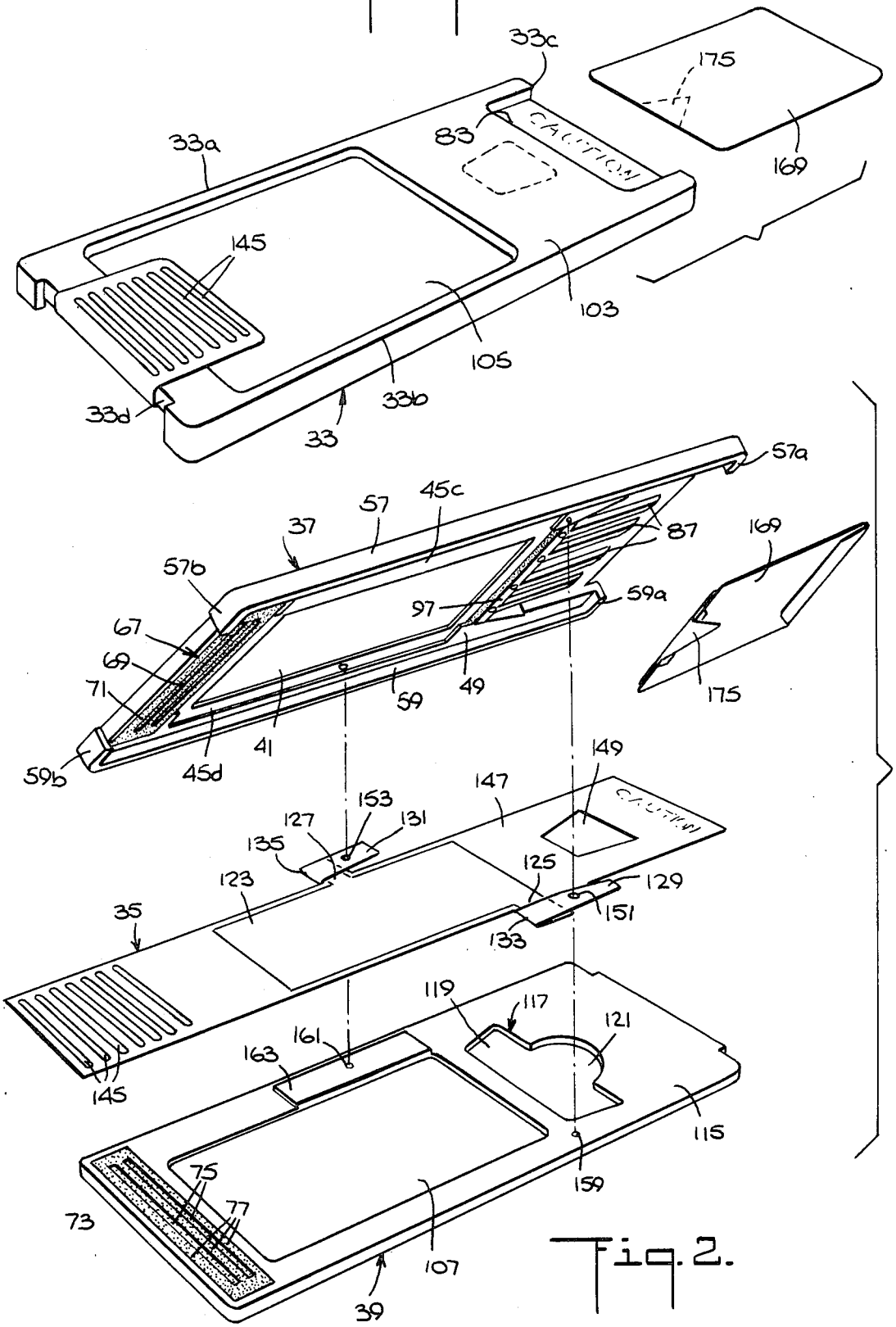
FIG. 1 is a perspective view of a film wrap and a film developing assembly in accordance with the present invention.
FIG. 2 is an exploded isometric view of the film wrap and film developing assembly of FIG. 1, showing a developer package and two halves of a developer container.

As illustrated in FIGS. 1 and 2, a disposable or throw away assembly for developing an exposed radiation sensitive film 31 (see, e.g., FIGS. 12–14) such as an X-ray film used in dental work comprises a container 33 and a developer package 35 disposed therein. Container 33 comprises a pair of molded synthetic resin halves 37 and 39 which are substantially co-extensive with one another. In an assembled state, container 33 has a pair of longitudinal edges 33*a* and 33*b* opposed to and substantially parallel to one another and extending from an inlet side 33*c* to an outlet side 33*d* of the container.

As shown in FIGS. 2 and 4, container half 37 is formed on an inner side with a rectangular reservoir region 41 defined by a rectangular lip 43 extending a small distance perpendicularly from the plane of the floor of reservoir region 41. Reservoir region 41 is surrounded by a rectangular platform 45 bounded on an inner edge by lip 43 and on a pair of opposed longitudinally extending sides by a pair of longitudinally extending rails or shoulders 47 and 49 lying in a common plane 51 (see FIGS. 5 and 6) spaced from the plane 53 of platform 45 and the plane 55 of reservoir region 41 (see FIG. 7).

Container half 37 has a pair of longitudinally extending sides 57 and 59 partially in the form of flanges provided at an inlet end of the container half with respective inwardly turned flange portions 57*a* and 59*a* and, similarly, at an outlet end of the container half with respective inwardly turned flange portions 57*b* and 59*b*. The gap 61 between flange portions 57*a* and 59*a* and the gap 63 between flange portions 57*b* and 59*b* define respectively an inlet opening and an outlet opening of container body 33 in an assembled state thereof. As illustrated in FIGS. 5–8, sides 57 and 59 of container body half 37 project from the plane 51 of shoulders 47 and 49 in a direction away from reservoir region 41 and rectangular platform 45.

As illustrated in FIGS. 4 and 8, container half 37 is provided at the outlet end of container 33 with a substantially rectangular transversely extending recess 65 in which a squeegee member 67 made of resilient material such as rubber is inserted. Squeegee member 67 is provided with a pair of cross-sectionally V-shaped parallel grooves 69 which divide the surface of the squeegee member into three parallel ribs 71.

As illustrated in FIG. 2, container half 39 is likewise provided at an outlet end with a squeegee member 73 having a pair of cross-sectionally V-shaped parallel grooves 75 which divide the squeegee member 73 into three parallel ribs 77. In an assembled state of container 33 grooves 75 are aligned with grooves 69, as shown in FIG. 8, while ribs 77 engage ribs 71. The groove and rib structure of squeegee members 67 and 73 results in an improved fluid seal at the outlet end 33*d* of container 33 and improves the wiping action of the sealing members 67 and 73 effectuated as developer package 33 and film 31 are withdrawn from container 33.

Shoulders 47 and 49 are provided at an upstream end of container 33, i.e., at the inlet end 33*c* thereof, with a pair of recesses 79 and 81 which serve to decrease the amount of synthetic resin material used to fabricate container half 37. At inlet end 33*c*, shoulders 47 and 49 as well as sides 57 and 59 extend longitudinally beyond a transversely extending edge 83 of a wall 85 forming a broad side of container 33. Wall 85 is provided on an inner surface with four longitudinally extending parallel ribs 87 having inwardly facing surfaces lying in a plane 89 (see FIG. 5) spaced from the plane 51 of shoulders 47 and 49 on the same side of plane 51 as planes 53 and 55 (see FIG. 7).

Each rib 87 is provided in a middle region with a triangularly shaped tooth or projection 91. As shown in FIGS. 15–20, projections 91 have a ramp shaped side 93 facing the inlet end 33*c* of container body 33 and a step shaped side 95 facing the outlet end 33*d*.

Ribs 87 are joined at a downstream end to a transverse rib 97 extending from shoulder 47 on one side to shoulder 49 on the other side. Between rib 97 and a transversely extending upstream portion 45*a* of platform 45 container half 37 is formed with a transverse groove 99 (see FIGS. 15–20) in which an elongate sponge 101 is inserted.

Container half 37 is provided on an outside surface 103 (see FIG. 1) with a rectangularly shaped recess or indentation 105 substantially co-extensive with reservoir 41 and platform 45. Owing to indentation 105 the thickness of container half 37 in the area of reservoir region 41 is substantially less than the thickness of the container half in the region of ribs 87.

As illustrated in FIGS. 5–8, container half 39 is substantially co-extensive with container half 37 and engages shoulders 47 and 49 and sides 57 and 59 in an assembled state of container 33. Container half 39 is advantageously secured to container half 37 along shoulders 47 and 49 by means of ultrasonic welding. However, other methods of attaching container halves 37 and 39, such as heat sealing, may be utilized.

As illustrated in FIG. 2, container half 39 is formed with a recess or indentation 107 which is substantially co-extensive with reservoir region 41 of container half 37 in an assembled state of container 33. Reservoir region 41 and indentation 107 cofunction to define a developing chamber 109 (FIGS. 15–20) for holding film 31 and film-treating fluid from developer package 35. Chamber 109 has a pair of flanking portions or lateral extensions 111 and 113 (FIG. 7) defined by and co-extensive with longitudinal portions 45*b* and 45*c* (FIG. 4) of platform 45.

At an end opposite squeegee member 73 container half 39 has a portion 115 with a thickness greater than the thickness of container half 39 in the region of indentation 107. Portion 115 of container half 39 is provided with a second recess or indentation 117 in the form of a trapezoid 119 joined to a semicircle 121. Upon the attaching of container half 39 to container half 37, indentation 117 faces wall 85 in the region of ribs 87 and projections 91.

Figure 9:
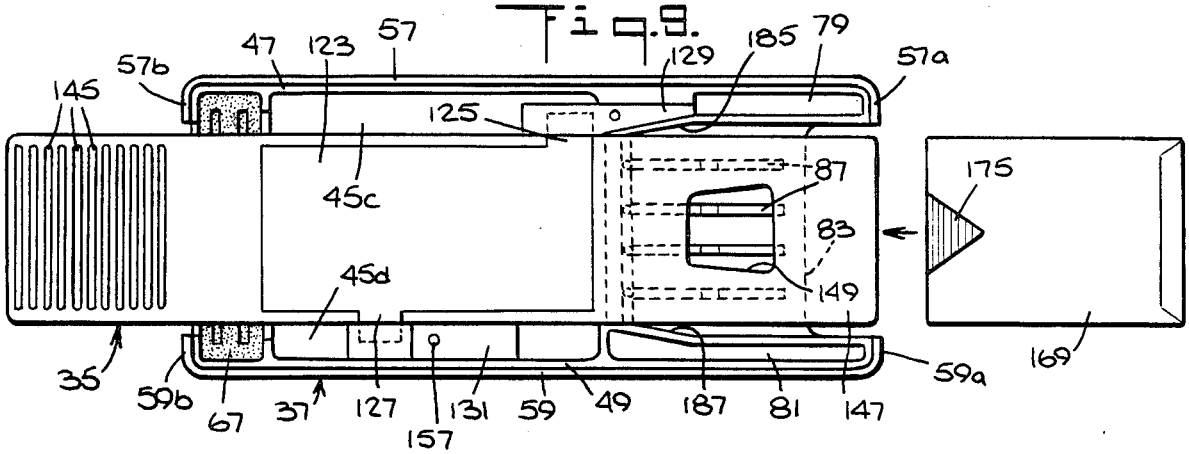
FIG. 9 is a top view of the film wrap of FIGS. 1 and 2, of the developer package of FIGS. 2 and 3 and of the developer container half of FIGS. 2 and 4, showing the relative positions of the developer package and the container half in an assembled state of the film developer.

As illustrated in FIG. 3, developer package 35 substantially comprises an envelope having a rectangular pocket 123 with a pair of laterally projecting finger-like bays or extensions 125 and 127 which are longitudinally staggered with respect to one another. A pair of elongate tabs 129 and 131 are attached to envelope 35 at pocket extensions 125 and 127, respectively. Tabs 129 and 131 are provided with respective creases 133 and 135, whereby the tabs are folded over to partially overlap the respective extensions 125 and 127, as illustrated in FIG. 9. The tabs are also provided with respective cuts 137 and 139 oriented at an angle with respect to longitudinal edges 141 and 143 of envelope 35.

At one end envelope 35 is provided with a multiplicity of elongate beads 145 extending perpendicularly to longitudinal edges 141 and 143. Beads 145 function as knurls for facilitating the gripping of the envelope or package 35 by a user. As illustrated in FIG. 1, the portion of envelope 35 provided with knurls 145 is advantageously folded over a transverse edge of container half 37 or 39 to facilitate storage of the developer assembly prior to use thereof.

Figure 10:
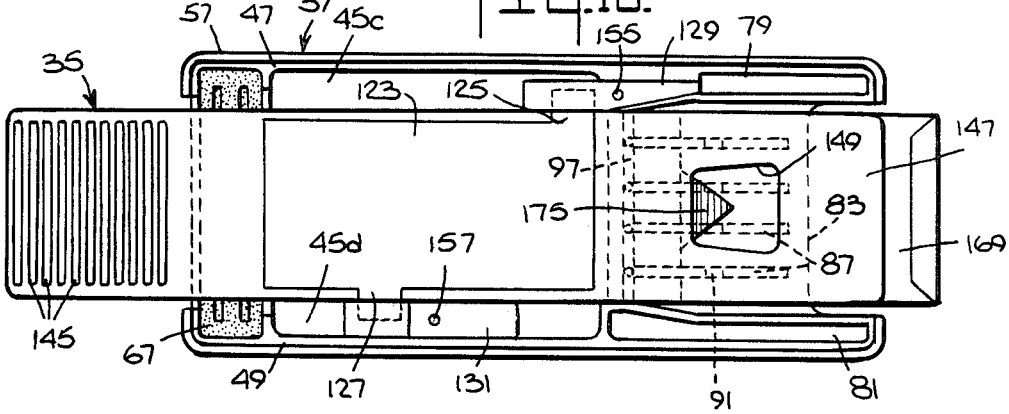
FIG. 10 is a top view similar to FIG. 9, showing the film wrap inserted into an entry chamber of the container assembly and between a trailing portion of the developer package and an inlet end of the container half.

At an end opposite knurls 145 envelope 35 is provided with a rectangular portion 147 having a trapezoidal aperture 149 which is positioned over two middle ones of ribs 87 prior to a withdrawal of envelope 35 from container 33, as illustrated in FIGS. 9 and 10.

Upon a folding of tabs 129 and 131 at creases 133 and 135, envelope 35 is placed on container half 37 so that a pair of holes or apertures 151 and 153 in tabs 129 and 131 overlie respective nipples 155 and 157 formed on shoulder 47 and platform portion 45*d*, as illustrated in FIG. 4. Container half 39 is provided with a pair of recesses 159 and 161 which receive nipples 155 and 157 upon a placing of container half 39 over envelope 35 and container half 37. Recess 161 is disposed in an elongate rectangular synthetic sheet 163 which facilitates the insertion of nipple 157 into recess 161 and the attachment of tab 131 to container halves 37 and 39.

As shown in FIGS. 13 and 14, X-ray sensitive film 31 is provided at a leading edge 165 with a pull tab 167 made of flexible synthetic resin material. During use of film 31, the film is contained in a film wrap 169 (see FIGS. 1, 2 and 9–11) the structure of which is described in detail hereinafter with respect to FIG. 18. While film 31 is contained in film wrap 169, pull tab 167 is folded back upon the film at a crease or joint 171 proximate to film edge 165 and is folded back upon itself at a second crease 173. A leading end of pull tab 167 takes the form of a reinforced triangular tooth 175 which is disposed outside of film wrap 169 during storage and exposure of film 31, tooth or triangular portion 175 being folded back upon an outer surface of film wrap 169 along a crease 177. During use and exposure of film 31, triangular portion 175 of pull tab 167 is advantageously tucked at the vertex 179 of the triangle 175 into a slit or slot (not illustrated) in an outer surface of film wrap 169.

Figures 15, 16, 17, 18:
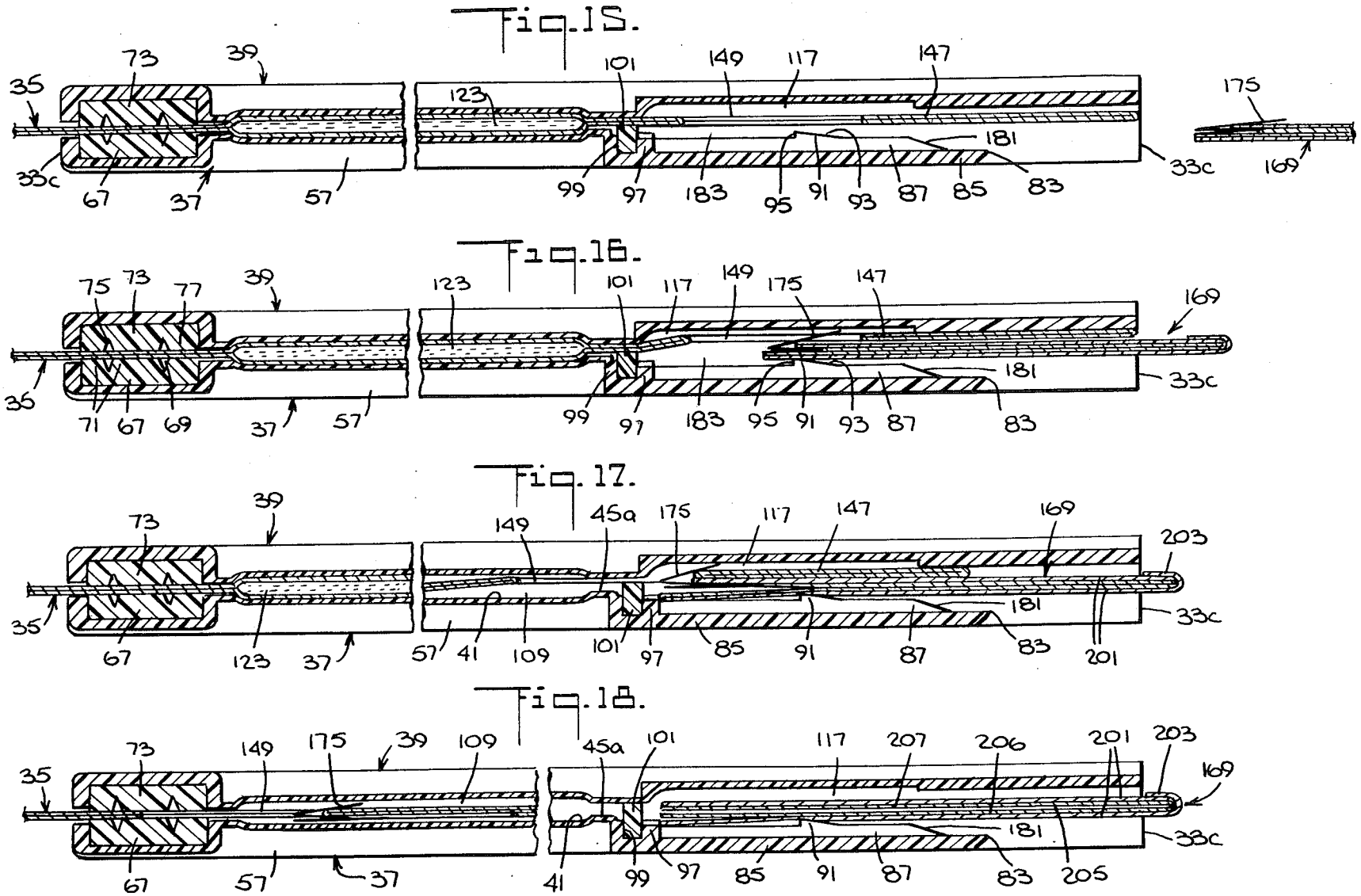
FIG. 15 is a longitudinal cross-sectional view, on an enlarged scale, showing the film wrap and film developer of FIG. 1 prior to an insertion of the film wrap into an entry chamber of the container.
FIG. 16 is a longitudinal cross-sectional view similar to FIG. 15, showing the film wrap partially inserted into the entry chamber of the container.
FIG. 17 is a longitudinal cross-sectional view similar to FIGS. 15 and 16, showing the film wrap completely inserted in the entry chamber of the container.
FIG. 18 is a longitudinal cross-sectional view similar to FIGS. 15–17, showing the film withdrawn from the film wrap and disposed in the film developing chamber of the container.

Upon the exposure of film 31, vertex 179 of pull tab portion 175 is removed from the slot in the surface of film wrap 169. The leading portion of film wrap 169, i.e., the end of the film wrap from which pull tab tooth 175 extends, is inserted into developer container 33 between the trailing portion 147 of envelope 35 and ribs 87 of container half 37, as illustrated in FIGS. 9, 10, 15 and 16. During this insertion step, triangular pull tab portion 175 faces trailing portion 147 of envelope 35 and container half 39. As shown in FIGS. 15 and 16, ribs 87 are each formed at an upstream end, i.e., at an end proximate to edge 83 and the inlet end 33*c* of container 33, with a sloped edge or ramp shape 181 for facilitating the insertion of film wrap 169 into a space or chamber 183 between container halves 37 and 39 at the inlet end 33*c* of container 33. The ribs 87 cofunction with the wall of container half 37 to guide or position film wrap 169 upon insertion thereof into chamber 183.

Figure 11:
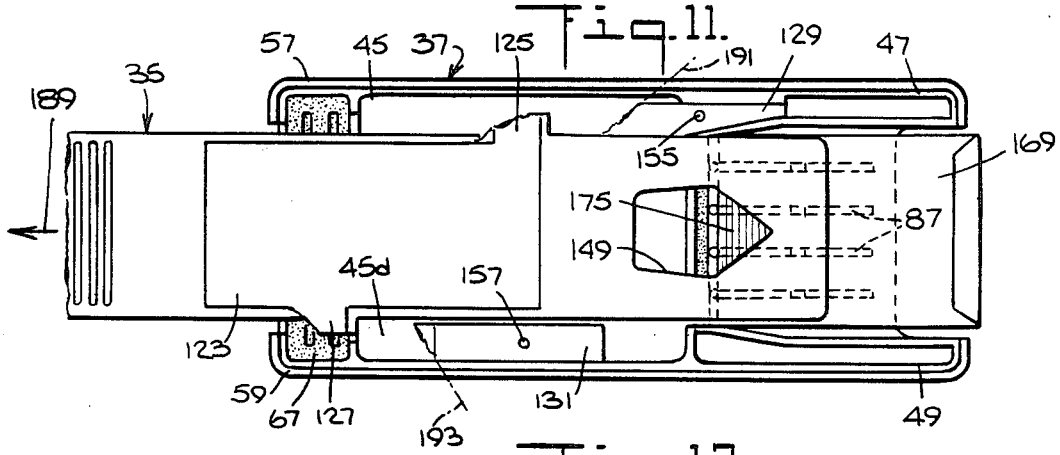
FIG. 11 is a top view similar to FIGS. 9 and 10, showing the developer package with ruptured lateral extensions upon a partial withdrawal of the developer package through an outlet opening of the container.
Figure 12:
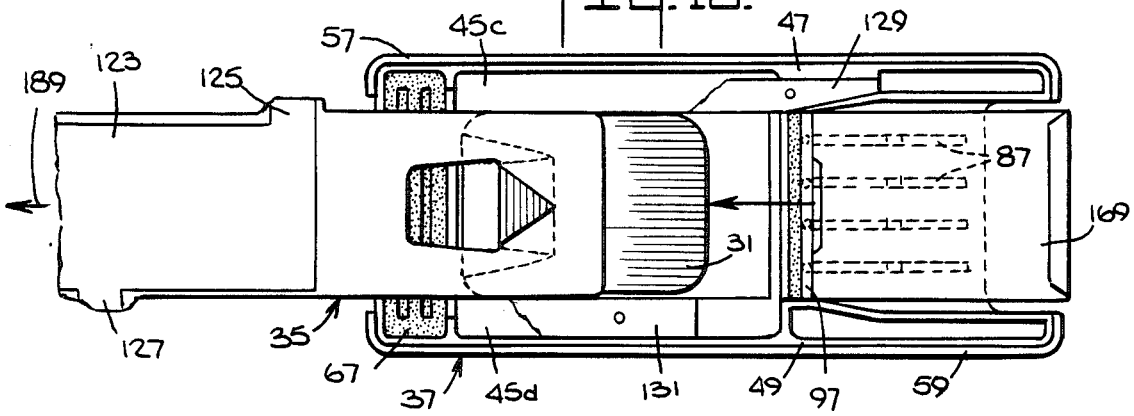
FIG. 12 is a top view similar to FIGS. 9–11, showing the film upon withdrawal thereof from the film wrap and disposition thereof in a developing chamber.
Figure 19:
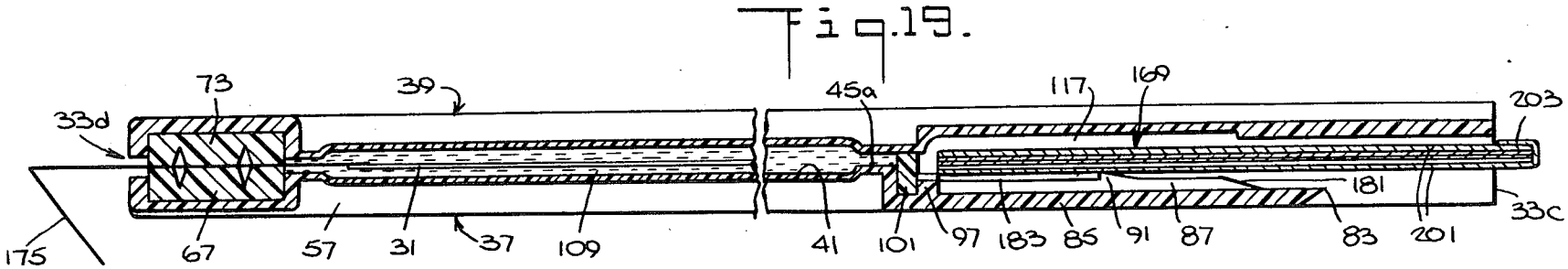
FIG. 19 is a longitudinal cross-sectional view similar to FIGS. 15–18, showing the film in the developing chamber and a pull tab at a leading end of the film extending through an outlet opening of the container.

The motion of container wrap 169 into chamber 183 of container body 33 is arrested by a pair of surfaces 185 and 187 (see FIGS. 9–14) which are generally perpendicular to the walls or broad sides of container halves 37 and 39 and are oriented at an angle with respect to sides 57 and 59. Inclined surfaces 185 and 187 arrest the forward motion of film wrap 169 so that the leading edge thereof approximately coincides with transverse rib 97, as shown in FIGS. 11 and 12. The inclined surfaces 185 and 187 also serve as guides for positioning the film wrap in a transverse direction.

Upon the complete insertion of film wrap 169 into chamber 183, the user unfolds the forward portion of envelope 35 from the outer surface of container 33 (see FIG. 1), grasps envelope 35 at knurls 145 and pulls the envelope out through outlet opening 63 (see FIG. 4) in the direction of arrow 189 (see FIGS. 11 and 12). Upon the movement of envelope 35 in the direction of arrow 189, tabs 129 and 131 are torn generally along respective lines 191 and 193 extending from cuts 137 and 139 through pocket extensions 125 and 127, as shown in FIGS. 3 and 11. The tearing of tabs 129 and 131 at extensions 125 and 127 enables the release of film treating fluid from pocket 123 into developing chamber 109 (FIG. 17). The distance of crease 133 from extension 125 is preferably less than the distance of crease 135 from extension 127, whereby it is ensured that envelope 35 begins to tear open at extension 125 before it begins to tear open at extension 127. In the preferred embodiment illustrated in the drawings, cuts 137 and 139 are equidistant from extensions 125 and 127, and tab 129 begins to tear at cut 137 prior to the tearing of tab 131 at cut 139. The delay in the tearing of tab 131 results in a more even resistance of the envelope to pulling forces than in the case where the tabs are torn simultaneously. The delay thus makes it easier to pull the envelope out of container 33. The folding of the tabs over the pocket extensions serves in part to increase reliability in the direction of the tears made through the extensions.

The film 31, as well as the greater portion of pull tab 167, are initially enclosed in film wrap 169. Upon the entrainment of the film by the engagement of a trailing edge of aperture 149 with triangular pull tab portion 175, film 31 is pulled out of film wrap 169, rupturing the wrap. The pressure placed by a user on film wrap 169 during withdrawal of the film causes the wrap to buckle or wrinkle. The undulations or pucker is preserved at a leading end of film wrap 169 by the clamping action of projections 91 and the inside surface of container half 39. The pucker thus held between transverse rib 97 and projections 91 substantially blocks or inhibits the penetration of light waves into developing chamber 109. For purposes of clarity, the pucker has not been shown in the drawing.

Pull tab 167 unfolds at creases 171 and 173 during the withdrawal of envelope 35. Generally the unfolding occurs before the withdrawal of film 31 from film wrap 169 is completed, although this is not necessarily the case.

Prior to and after the tearing of tabs 129 and 131, the user may exert a compressive force on container halves 37 and 39 in the region of developing chamber 109 for applying pressure to envelope 35 to accelerate the release of film treating fluid from pocket 123 into developing chamber 109. To this end the thickness of one or both of the container halves 37 and 39 in the region of chamber 109 may be relatively small to enable a flexing of one or both container halves. The flexibility or resilience of the container halves may be controlled also by choice of material. Container halves 37 and 39 are preferably relatively rigid in the region of receiving chamber 183 at least in part for preserving the pucker formed in film wrap 169 upon the insertion thereof into chamber 183.

As illustrated in FIGS. 16 and 17, indentation 117 serves to receive triangular pull tab portion 175 and to facilitate the traversal thereby of aperture 149 in envelope 35.

During withdrawal of envelope 35 from container 33, film 31 is pulled from film wrap 169 into developing chamber 109 which has been filled with developing fluid from pocket or pouch 123. The release of the fluid from pocket 123 into chamber 109 is implemented in part by squeegee members 67 and 73 which exert a compressive force on envelope 35 during the withdrawal thereof from container 33.

Figure 20:
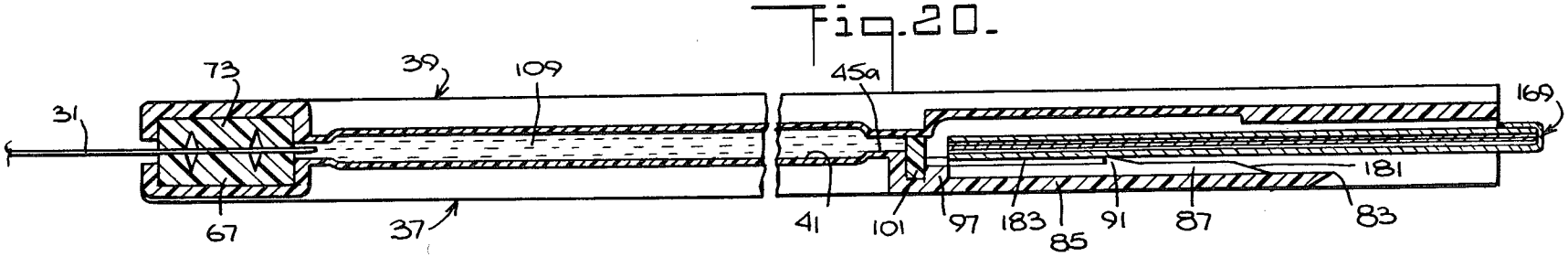
FIG. 20 is a longitudinal cross-sectional view similar to FIGS. 15–19, showing the film partially withdrawn from the developing chamber of the developer container.
Figure 19:
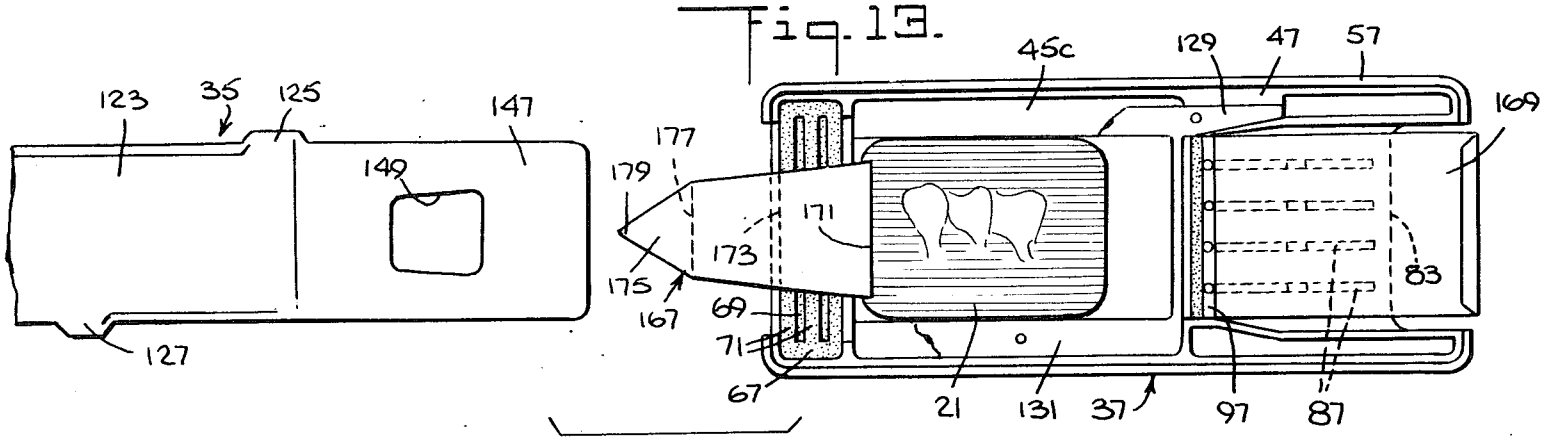

As illustrated in FIG. 13, triangular pull tab portion 175 is released from aperture 149 upon the passage of trailing envelope portion 147 and pull tab 167 through outlet 63 of container 33. This automatic release of pull tab 167 ensures that film 31 is not inadvertently withdrawn from the developing chamber before the completion of the developing process. At the appropriate moment the user grips pull tab 167 and withdraws film 31 from chamber 109, as illustrated in FIGS. 14 and 20. During the removal of film 31 from chamber 109, squeegee members 67 and 73 wipe film 31 substantially clean of any developing fluid clinging thereto. At the end of developing chamber 109 opposite squeegee members 67 and 73 sponge 101 acts to prevent the passage of developing fluid from chamber 109 into chamber 183.

As illustrated in FIG. 18, film wrap 169 comprises an outer layer 201 of a synthetic resin material which substantially surrounds film 31 when the film is disposed within the film wrap. At one end of film wrap 169 layer 201 has a folded over flap 203. On one side of the film wrap, layer 201 is formed on an inner surface with a metal foil 205 in turn coated with an extremely thin layer 206 of polyethylene. Between the web comprising layer 201 and metal layer 205, on the one hand, and the other side of web or layer 201, on the other hand, is advantageously provided a third web 207 of synthetic resin material which serves to stiffen film wrap 169. Film 31 is disposed between web 207 and polyethylene layer 206. Web 207 may be partially or totally separate from synthetic resin layer 201.

Metal layer 205 has a flap (not illustrated) at an end of film wrap 169 opposite flap 203 for closing the film wrap at a leading end thereof. Triangular pull tab portion 175 (see FIG. 17) extends through the flap of foil 205 at the leading end of film wrap 169. Upon the engagement of triangular pull tab portion 175 and aperture 149 of envelope 35 and the withdrawal of envelope 35 from container 33, the flap of foil 205 at the leading end of film wrap 169 is ruptured by the leading edge 165 (see FIG. 14) of film 31.

Although the invention has been described in terms of specific embodiments and application, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. An assembly for developing an exposed radiation sensitive film, comprising:

a container having a chamber therein, said chamber having an inlet end and an outlet end;

a developer package positioned in said chamber, said developer package comprising a sealed rupturable envelope containing a film treating fluid;

tab means integral with said envelope and secured to said container, whereby as said envelope is drawn from said chamber said tab means is torn to rupture said envelope to permit said fluid to enter said chamber, said tab means including a first tab and a second tab spaced from one another, said first tab being disposed at a distance from said inlet end substantially less than the distance of said second tab from said inlet end; and linking means for coupling said envelope to the film, whereby said film is positioned in said chamber as the ruptured envelope is withdrawn therefrom.

2. The assembly defined in claim 1, further comprising delay means for ensuring that the rupture of said envelope at one of said tabs occurs after the rupture of said envelope at the other of said tabs.

3. The assembly defined in claim 2, wherein said delay means ensures that the rupture of said envelope at said second tab occurs after the rupture of said envelope at said first tab, said envelope having a fluid-storage pocket, said first tab having a first cut and said second tab having a second cut, said cuts and said delay means causing said first tab to tear substantially along a first line from said first cut to said pocket as said envelope is withdrawn from said chamber and said second tab to tear substantially along a second line from said second cut to said pocket as said envelope is withdrawn from said chamber, said first cut and said second cut being spaced at substantially equal distances along said first line and said second line from said first extension and said second extension, respectively, said delay means comprising said first tab tearing at said first cut prior to the tearing of said second tab at said second cut.

4. The assembly defined in claim 3, wherein said container has a first longitudinal edge and a second longitudinal edge opposed to one another, said pocket having a first extension projecting towards said first longitudinal edge and a second extension projecting towards said second longitudinal edge, said first line intersecting said first extension and said second line intersecting said second extension so that said pocket is torn initially at said first extension and subsequently at said second extension as said envelope is withdrawn from said chamber.

5. The assembly defined in claim 1, wherein said first tab and said second tab are connected to said container by means of respective nipples on said container engaging said tabs.

6. The assembly as defined in claim 1, wherein said container has a first side and a second side forming in part respective walls of said chamber, at least one of said sides being resilient in the region of said chamber, whereby said container may be squeezed to put pressure on said envelope and thereby accelerate the distribution of said film treating fluid throughout said chamber upon withdrawal of said envelope from said chamber.

7. An assembly for developing an exposed radiation sensitive film, comprising:

a container having a chamber therein, said chamber having an inlet end and an outlet end, said container having a first longitudinal edge and a second longitudinal edge opposed to one another;

a developer package positioned in said chamber, said developer package comprising a sealed rupturable envelope having a fluid-storage pocket containing film-treating fluid, said pocket having at least one finger-like extension projecting towards one of said longitudinal edges;

tab means including a pull tab integral with said envelope at said extension, said pull tab being secured to said container at said one of said longitudinal edges, whereby as said envelope is withdrawn from said chamber said tab means is torn to rupture said envelope at said extension to permit said fluid to enter said chamber; and linking means for coupling said envelope to the film, whereby said film is positioned in said chamber as the ruptured envelope is withdrawn therefrom.

8. The assembly defined in claim 7 wherein said pocket has a finger-like first extension projecting towards said first longitudinal edge and a finger-like second extension projecting towards said second longitudinal edge, said one finger-like extension constituting said first extension, said tab means including an additional tab integral with said envelope at said second extension, said pull tab and said additional tab being secured to said container at said first and said second longitudinal edge, respectively.

9. The assembly defined in claim 8, further comprising delay means on said envelope for ensuring that the rupture thereof at one of said extensions occurs after the rupture of said envelope at the other of said extensions.

10. The assembly defined in claim 9 wherein said tabs are folded at respective creases to overlie respective ones of said extensions, said delay means comprising said creases being spaced from the respective extensions at different distances.

11. The assembly defined in claim 8 wherein said first extension and said pull tab are disposed at a distance from said inlet end less than the distance of said second extension and said additional tab from said inlet end.

12. The assembly defined in claim 11, further comprising delay means on said envelope for ensuring that the rupture thereof at said second extension occurs after the rupture of said envelope at said first extension.

13. The assembly defined in claim 12 wherein said pull tab is folded at a first crease to overlie said first extension, said pull tab having a first cut and being torn substantially along a first line from said first cut to said first extnesion as said envelope is withdrawn from said chamber, said additional tab being folded at a second crease to overlie said second extension, said additional tab having a second cut and being torn along a second line from said second cut to said second extension as said envelope is withdrawn from said chamber, said delay means comprising said first crease being spaced from said first extension at a distance less than the distance of said second crease from said second extension.

14. The assembly as defined in claim 7, wherein said container has a first side and a second side forming in part respective walls of said chamber, at least one of said sides being resilient in the region of said chamber, whereby said container may be squeezed to put pressure on said envelope and thereby accelerate the distribution of said film treating fluid throughout said chamber upon withdrawal of said envelope from said chamber.

15. The assembly defined in claim 7, wherein said pull tab is connected to said container by means of a nipple on said container engaging said pull tab.

16. The assembly defined in claim 8 wherein said chamber is substantially planar and has a main portion of a first thickness and a first flanking portion between said main portion and said first longitudinal edge and a second flanking portion between said main portion and said second longitudinal edge, said first and said second flanking portion each having a second thickness less than said first thickness, said first extension being disposed in said first flanking portion and said second extension being disposed in said second flanking portion, whereby fluid flows from said pocket to said main portion through said flanking portions.

17. The assembly defined in claim 7 wherein said developer package has a leading portion extending out of said container at said outlet end, said leading portion being provided on at least one side with a plurality of knurls.

18. The assembly defined in claim 17 wherein said knurls are elongate beads.

19. The assembly defined in claim 7 wherein said container has an entry chamber at said inlet end for receiving a film wrap containing said film, further comprising gripping means integral with said container in said entry chamber for at least inhibiting the release of a pucker formed in said film wrap by manually exerted forces during a removal of said film from said film wrap.

20. The assembly defined in claim 19 wherein said container has a pair of opposed walls and said gripping means comprises a projection extending in said entry chamber from one of said walls towards the other of said walls.

21. The assembly defined in claim 7 wherein said pull tab is folded at a crease to at least partially overlap said extension and is fastened to said container on a side of said extension opposite said crease.

22. An assembly for developing an exposed radiation sensitive film, comprising:

a container having an inlet end and an outlet end, said container having a substantially flat entry chamber at said inlet end for receiving a film wrap containing the film, said container further having a substantially flat developing chamber between said entry chamber and said outlet end for receiving said film and film-treating fluid;

a developer package disposed in said developing chamber, said developer package comprising a sealed rupturable envelope containing said film-treating fluid;

tab means integral with said envelope and secured to said container, whereby as said envelope is withdrawn from said developing chamber out through said outlet end, said tab means is torn to rupture said envelope to permit said fluid to enter said developing chamber;

linking means for coupling said envelope to said film, whereby said film is positioned in said developing chamber after the ruptured envelope is withdrawn therefrom; and light blocking means on said container cooperating with said film wrap for at least partially preventing entry of light through said input end into said developing chamber, said light blocking means including gripping means integral with said container in said entry chamber for at least inhibiting the release of a pucker formed in said film wrap by manually exerted forces during a removal of said film from said film wrap.

23. The assembly defined in claim 22 wherein said container has two opposed walls and said gripping means comprises a projection extending in said entry chamber from one of said walls towards the other of said walls.

24. The assembly defined in claim 23 wherein said projection has a ramp shape on a side facing said inlet end and a step shape on a side facing said developing chamber.

25. The assembly defined in claim 23 wherein both of said walls are rigid in the region of said entry chamber and at least one of said walls is resilient in the region of said developing chamber, whereby said container may be squeezed in envelope and thereby accelerate the distribution of said film-treating fluid throughout said developing chamber upon withdrawal of said envelope from said developing chamber.

26. An assembly for developing an exposed radiation sensitive film, comprising:

a container having a chamber therein, said chamber having an inlet end and an outlet end;

a developer package positioned in said chamber, said developer package comprising a sealed rupturable envelope containing a film treating fluid:

tab means integral with said envelope and secured to said container, whereby as said envelope is drawn from said chamber said tab means is torn to rupture said envelope to permit said fluid to enter said chamber, said tab means including a first tab and a second tab;

linking means for coupling said envelope to the film, whereby said film is positioned in said chamber as the ruptured envelope is withdrawn therefrom; and delay means for ensuring that the rupture of said envelope at said second tab occurs after the rupture of said envelope at said first tab.

27. The assembly defined in claim 26 wherein said first tab is disposed at a distance from said inlet end less that the distance of said second tab from said inlet end.

28. An assembly for developing an exposed radiation sensitive film comprising:

a container having an inlet end and an outlet end, said container having a substantially flat entry chamber at said inlet end for receiving a film wrap containing the film, said container further having a substantially flat developing chamber between said entry chamber and said outlet end for receiving said film and a film-treating fluid;

a developer package disposed in said developing chamber, said developer package comprising a sealed rupturable envelope containing said film-treating fluid;

tab means integral with said envelope and secured to said container, whereby as said envelope is withdrawn from said developing chamber out through said outlet end, said tab means is torn to rupture said envelope to permit said fluid to enter said developing chamber;

linking means for coupling said envelope to said film, whereby said film is positioned in said developing chamber after the ruptured envelope is withdrawn therefrom;

light blocking means on said container cooperating with said film wrap for at least partially preventing entry of light through said input end into said developing chamber; and flow blockage means between said entry chamber and said developing chamber for substantially preventing the passage of fluid from said developing chamber into said entry chamber, said flow blockage means including an elongate sponge.

29. An assembly for developing an exposed radiation sensitive film, comprising:

a container having an inlet end and an outlet end, said container having a substantially flat entry chamber at said inlet end for receiving a film wrap containing the film, said container further having a substantially flat developing chamber between said entry chamber and said outlet end for receiving said film and a film-treating fluid, said container having a pair of opposed substantially parallel edges extending from said inlet end to said outlet end;

a developer package disposed in said developing chamber, said developer package comprising a sealed rupturable envelope containing said film-treating fluid;

tab means integral with said envelope and secured to said container, whereby as said envelope is withdrawn from said developing chamber out through said outlet end, said tab means is torn to rupture said envelope to permit said fluid to enter said developing chamber;

linking means for coupling said envelope to said film whereby said film is positioned in said developing chamber after the ruptured envelope is withdrawn therefrom;

light blocking means on said container cooperating with said film wrap for at least partially preventing entry of light through said input end into said developing chamber; and flow blockage means at said outlet end for substantially preventing the passage of fluid from said developing chamber past said outlet end and for wiping fluid from said film as same is withdrawn from said developing chamber upon the development of said film, said flow blockage means comprising a resilient member provided with at least one groove extending substantially perpendicularly to said longitudinal edges.

* * * * *